United States Patent [19]

Randall

[11] 4,244,058

[45] Jan. 13, 1981

[54] DISPOSABLE CAP CONSTRUCTION

[75] Inventor: James E. Randall, Worthington, Ohio

[73] Assignee: Lin-N-Look Company, Inc., Columbus, Ohio

[21] Appl. No.: 69,876

[22] Filed: Aug. 27, 1979

[51] Int. Cl.[3] ..... A42B 1/22

[52] U.S. Cl. ..... 2/197

[58] Field of Search ..... 2/197, 195, 175

[56] References Cited

U.S. PATENT DOCUMENTS

| | | | |
|---|---|---|---|
| 3,728,740 | 4/1973 | Wagenfeld | 2/197 |
| 4,186,446 | 2/1980 | Maney | 2/197 |

FOREIGN PATENT DOCUMENTS

| | | | |
|---|---|---|---|
| 1521635 | 8/1978 | United Kingdom | 2/195 |

*Primary Examiner*—Peter P. Nerbun

*Attorney, Agent, or Firm*—William S. Rambo

[57] ABSTRACT

A disposable paper cap features a size adjustable headband having a pair of relatively telescoping male and female end flaps and formed with inwardly folded upper and lower hem portions separated by a single thickness intermediate section, and a pleated crown having opposite, downturned side panels one of which is adhesively secured to both the upper and lower hem portions of the female end flap of the headband to define therewith an open ended envelope slidably encasing the male end flap of the headband.

3 Claims, 7 Drawing Figures

DISPOSABLE CAP CONSTRUCTION

BACKGROUND OF THE INVENTION

This invention relates generally to disposable-type paper caps, and more particularly to disposable-type caps formed from adhesively connected crown and headband sections.

U.S. Pat. Nos. 3,383,709 issued May 21, 1968 to R. I. Bauer and 3,390,405 issued July 2, 1968 to W. J. Gruber represent the most pertinent prior art known to the applicant. Both of the aforesaid prior art patents disclose paper caps which include adhesively secured headband and crown sections, wherein the headband sections are formed to provide relatively telescoping end flap portions which may be adjusted to vary the head size of the cap. While the disposable cap disclosed in the aforesaid Gruber patent lends itself to machine folding, it, nevertheless, is relatively expensive to produce due to multiple thicknesses of material in the headband, and requires final hand assembly to tuck and fold the relatively interfitting end flaps of the headband one within the other. The modified cap illustrated in FIG. 7–11 of the Bauer patent is also difficult to manufacture and tends to separate or fall apart in use, since substantially all of the forces tending to enlarge or separate the end flaps of the headband are resisted only by frictional drag forces developed in the relatively telescoped end flaps of the headband, and the crown section does not absorb any of the forces which tend to separate the relatively telescoping end flaps of the headband.

SUMMARY AND OBJECTS OF THE INVENTION

The primary object of this invention is to provide a mechanically stronger and less expensive disposable cap as compared to those disclosed in the aforesaid U.S. Patents to Bauer and Gruber, and one which lends itself to production solely by machine operation, without the intervention of any hand tucking or folding.

A cap according to this invention comprises a headband section formed by folding a single, rectangular sheet of paper or the like along a pair of relatively spaced, parallel and longitudinally extending fold lines to provide double thickness upper and lower edge portions or hems separated by a single thickness, longitudinally coextensive intermediate panel; and by folding the headband along a pair of relatively spaced transverse fold lines to form relatively telescoping male and female end flaps along one side of the headband and a continuous side panel along the other side of the headband. A crown section is also formed by folding a single, rectangular sheet of paper or plastic film along a series of longitudinally extending fold lines to thereby provide a pair of downturned, outer side panels connected by a series of relatively expansible, accordion-style intermediate pleats. One downturned side panel of the crown section is adhesively secured to both the upper and lower double thickness hems of the female end flap of the headband section, and the other downturned panel of the crown is adhesively secured to the double thickness upper hem and single thickness intermediate portion of the continuous side panel of the headband section. The crown thus closes the inner side of the female end flap between the double folded hems and defines an open-ended envelope to slidably encase the male end flap of the headband.

DESCRIPTION OF THE PREFERRED EMBODIMENT

Figure 1:
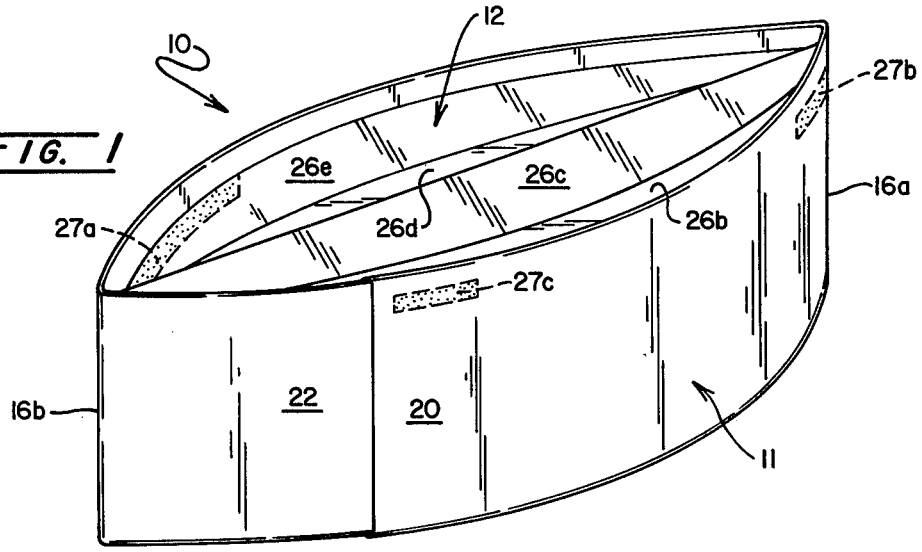
FIG. 1 is a perspective view of a disposable cap according to this invention.

As illustrated in FIG. 1, the present disposable cap, generally designated 10, comprises a headband section 11 and a crown section 12 adhesively secured to the headband section. The headband 11 is preferably fabricated from a relatively heavy, textured paper, while the crown is preferably formed from a comparatively lighter weight tissue paper or perforated crinoline-liked paper.

Figure 2:
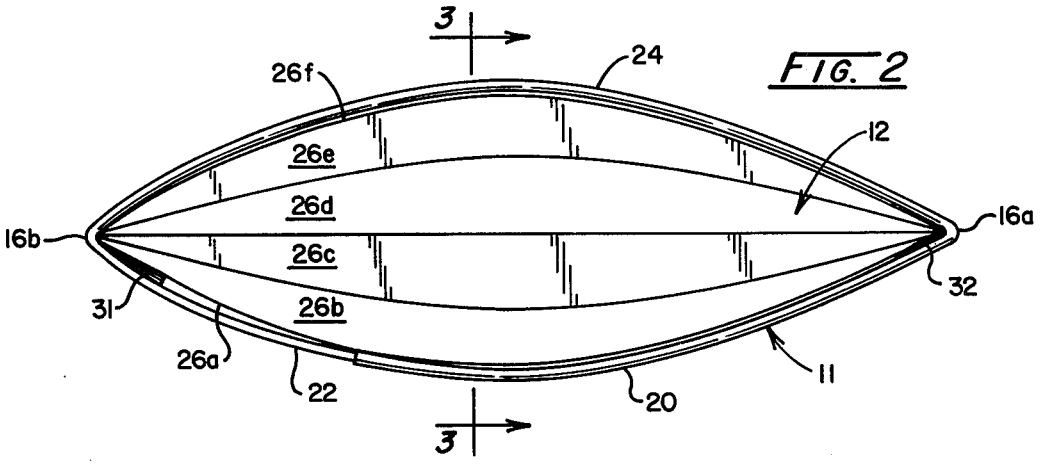
FIG. 2 is a top plan view thereof.
Figure 3:
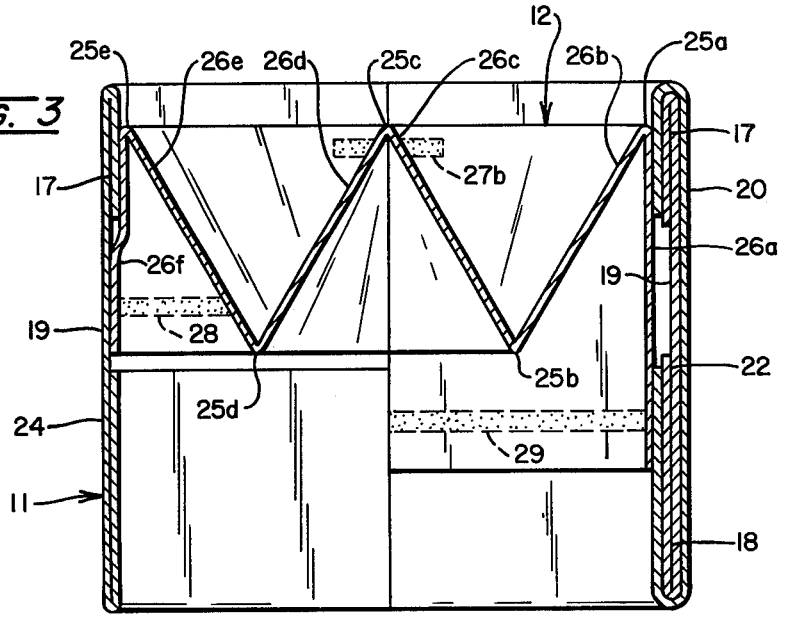
FIG. 3 is an enlarged vertical sectional view taken approximately along the plane indicated by line 3—3 of FIG. 2.
Figure 4:
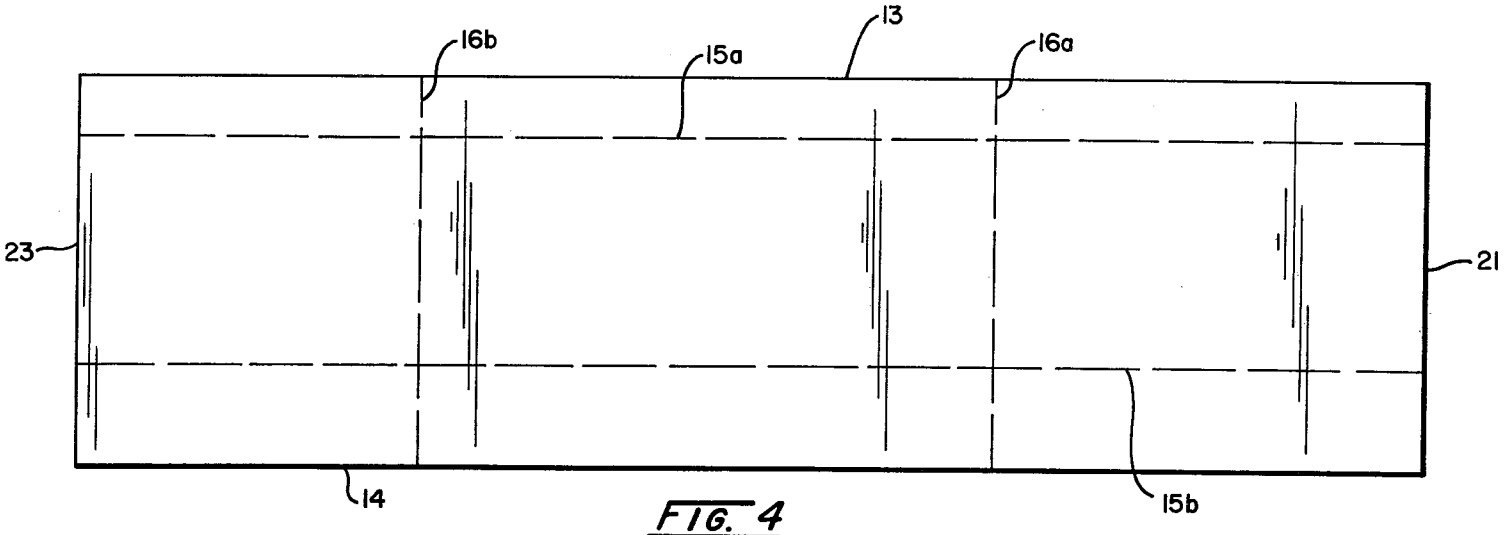
FIG. 4 is a smaller scale side elevational view of the headband in unfolded condition.
Figure 5:
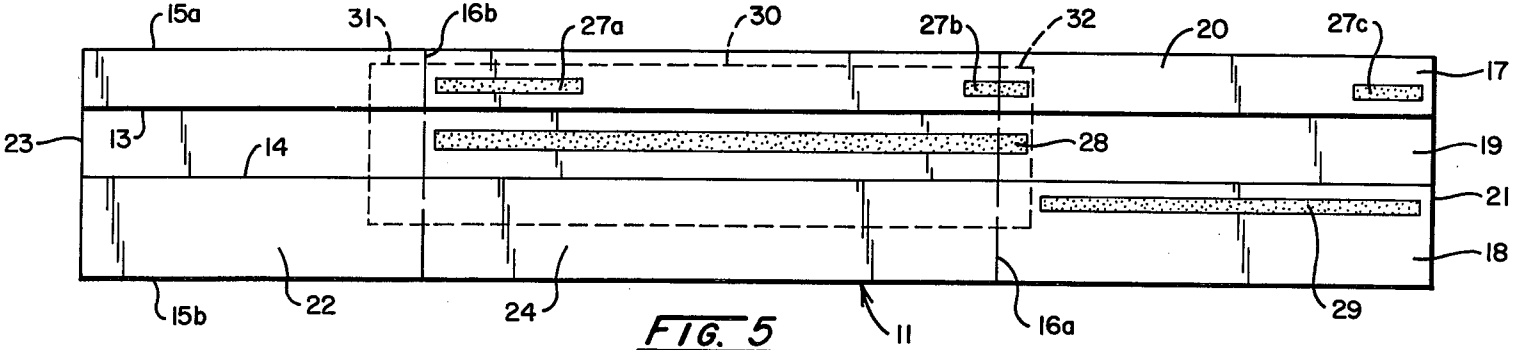
FIG. 5 is a side elevational view of the partially folded headband showing the relative position of the glue laps or adhesive areas and the crown section prior to interfitting the male end flap into the female end flap of the headband.

With particular reference to FIGS. 4 and 5 of the drawings, it will be seen that the headband section 11 is formed from a single, elongated, rectangular sheet or blank of flexible paper or plastic film. The blank is formed a distance inwardly from its longitudinal edges 13 and 14 with a pair of longitudinally extending fold lines **15*a* and 15*b*. The edges 13 and 14 are folded inwardly along the fold lines 15*a* and 15*b* to form upper and lower double thickness hem portions 17 and 18, respectively, which are separated by a single thickness intermediate portion 19. The headband blank is also formed with a plurality of transverse fold lines 16*a* and 16*b*. The transverse fold lines 16*a* and 16*b* normally define the front and rear ends of the headband and demarcate a forward, female end flap 20, a rearward, male end flap 22 and an intermediate, continuous side panel 24. The female and male end flaps 20 and 22 are folded inwardly upon the side panel 24 and are telescopically interfitted as shown in FIGS. 1–3. Preferably, the male end flap 22 is slightly shorter than the female end flap 20 and is slidable therein to adjust the head size or head opening of the cap. The headband blank is first folded longitudinally along the lines 15*a* and 15*b* before folding it transversely along lines 16*a* and 16*b***.

Figure 6:
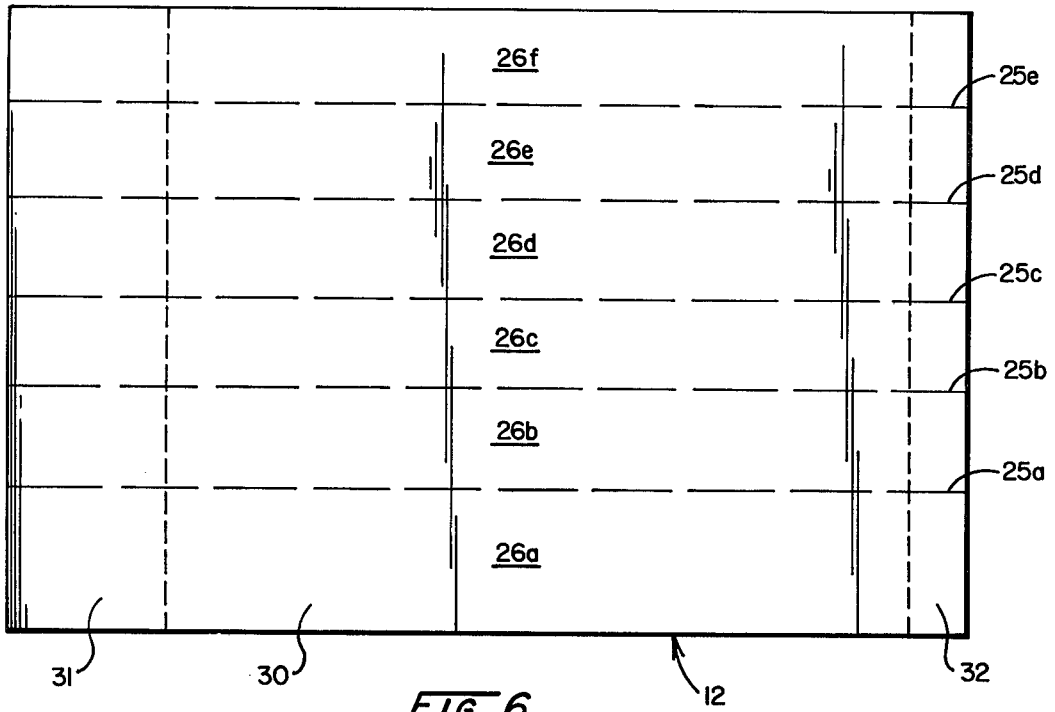
FIG. 6 is a plan view of the crown section in unfolded condition.

As illustrated in FIG. 6, the crown section 12 of the cap also consists of a single sheet or blank of flexible meterial formed with five relatively spaced apart, parallel longitudinal fold lines **25*a*, 25*b*, 25*c*, 25*d*, and 25*e*. As best seen in FIG. 3, the crown section 12 is folded longitudinally along the fold lines 25*a*, 25*b*, 25*c*, 25*d* and 25*e* to form a pair of opposite, downturned side panels 26*a* and 26*f* separated by a plurality of relatively expansible, accordion-type intermediate panels or pleats 26*b*, 26*c*, 26*d* and 26*e*. The side panel 26*a* is substantially wider than the opposite side panel 26*f* and the intermediate pleats 26*b*, 26*c*, 26*d* and 26*e*** for a purpose to be hereinafter explained.

The headband 11 and crown 12 are connected to one another in the following manner. With the headband 11 in its longitudinally folded condition as shown in FIG. 5, but before the female and male end flaps 20 and 22 are folded transversely inwardly, a series of longitudinally spaced glue laps or adhesive patches 27*a* 27*b* and 27*c* are applied to the inner side of the double thickness upper hem 17 of the headband. Simultaneously, relatively elongated adhesive patches 28 and 29 are applied to the inner sides of the single thickness intermediate panel 19 and to the lower double thickness hem 18, respectively.

Figure 7:
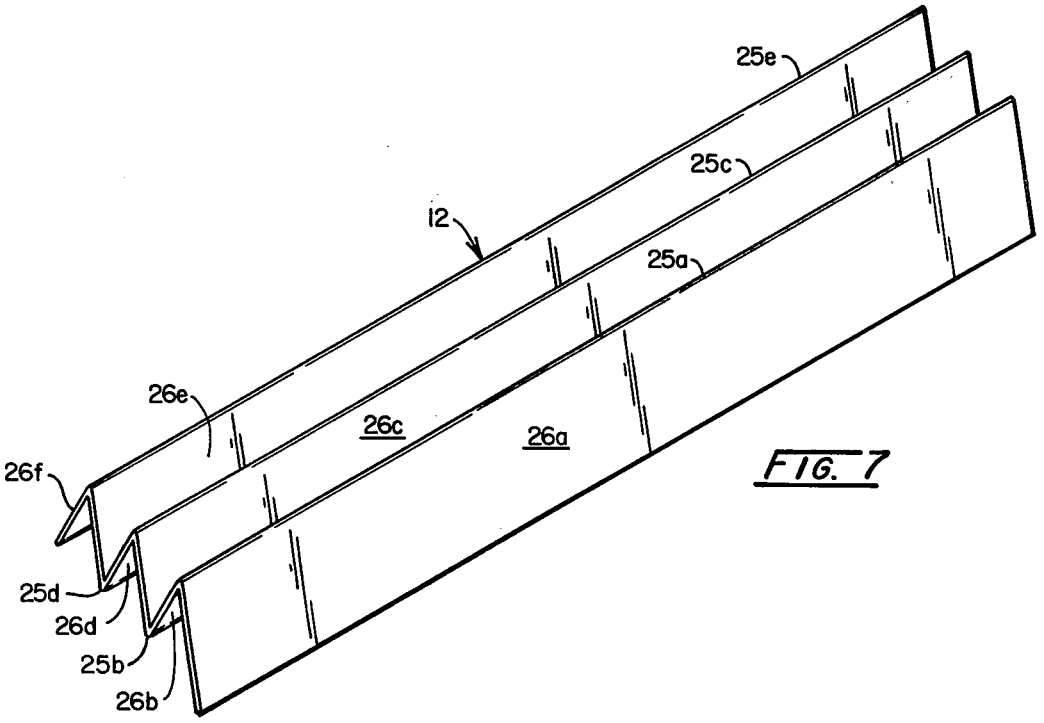
FIG. 7 is a perspective view of the crown section of the cap in its longitudinally folded condition.

The crown section 12, in the longitudinally folded condition illustrated in FIG. 7, is then applied to the area 30 of the headband shown by broken lines in FIG. 5, with the downturned outer panel 26*f* of the crown engaging and adhered to the adhesive patches 27*a*, 27*b* and 28. The female end flap 20 is then folded transversely inwardly along fold line 16*a* to engage and adhere the adhesive patches 27*c* and 29 with the upper and lower portions of the wider outer side panel 26*a* of the crown section 12. The male end flap 22 is then folded transversely inwardly along the fold line 16*b* and the end 23 of the male end flap is inserted and telescoped into the open end of the female end flap 20.

As will be noted from FIG. 5, the length of the crown section 12 is greater than that of the continuous side panel 24 of the headband 11, and the longitudinally folded crown section (see FIG. 7) is positioned upon and adhered to the headband, so that opposite end portions 31 and 32 of the crown section overlie and extend outwardly beyond the transverse fold lines 16*b* and 16*a*, respectively, of the headband section 11. Thus, when the female and male end flaps 20 and 22 are folded inwardly along the fold lines 16*a* and 16*b*, the extended end portions 31 and 32 are also folded inwardly to close the respective ends of the crown 12 of the cap, as indicated in FIG. 2.

It is important to note that when the glue laps or adhesive patches 27*c* and 29 are adhered to the wider outer side panel 26*a* of the crown section, panel 26*a*, in effect, joins or connects the hems 17 and 18 at the outer end 21 of the female end flap 20 and forms therewith a closed-sided, but open end envelope to slidably receive the male end flap 22 of the headband. This greatly facilitates the machine tucking or insertion of the male end flap 22 within the female end 20 of the headband and completely eliminates the hand folding and tucking operations heretofore required in assembling prior art paper caps such as those shown in the aforementioned U.S. Pat. to Bauer No. 3,383,709 and the Gruber No. 3,390,450. The adhesive patch 27*c* also secures the upper region of the crown section to the headband in a position approximately opposite the adhesive patch 27*a*. This substantially opposite disposition of the adhesive patches 27*a* and 27*c* causes the rearward portion of the crown section to be placed under light tension when the cap is placed on the head of the wearer, and thus protects against accidental withdrawal or separation of the male end flap 22 from the female end flap 20 particularly when the headband is expanded toward its maximum size.

In its completely assembled condition, the cap may be arranged in a substantially flat condition with the folded crown section 12 disposed in a flat folded condition between the continuous side panel 24 and the relatively overlying and telescoped end flaps 20 and 22. This flat folded condition greatly facilitates the packaging and storage of the caps. The fold lines 16*a* and 16*b* normally define the front and rear ends of the cap when the headband is adjusted to its smallest headsize. However, when it is desired to expand the cap to a larger headsize this may be easily accomplished simply by opening the headband and manually withdrawing a portion of the male end flap 22 from the female end flap until a comfortable head fit is attained. Alternatively, the headband may be simply "snugged down" upon the head of the wearer and this "snugging down" of the headband on the head will automatically cause withdrawal of the male end flap 22 to the extent necessary to conform the headband to the headsize of the wearer.

If desired, the male end flap 22 may be provided with a series of relatively closely spaced, transverse score or fold lines extending rearwardly of and parallel to the fold line 16*b*. Also, the lower, double thickness hem portion 18 of the male end flap may be provided with printed size indicia corresponding to a range of individual head sizes, so that the headband may be preadjusted to a selected headsize without first placing it upon the head of the wearer, all as taught in U.S. Pat. No. 3,390,405 to Gruber. In any event, the size of the headband of the cap may be easily adjusted to the headsize of the wearer due to the sliding, telescopic disposition of the male end flap within the closed-sided female end flap.

In view of the foregoing, it will be seen that this invention provides a materially improved disposable cap which utilizes a minimal amount of materials in its constuction, and which lends itself for total machine production and packaging.

While a single preferred embodiment of the invention has been illustrated and described in detail, it will be obvious that various modifications in design and detail of construction are possible without departing from the spirit of the invention or the scope of the following claims.

I claim:

1. A cap comprising relatively connected headband and crown sections, said headband section consisting of a single, elongated, rectangular piece of flexible sheet material folded longitudinally upon itself to define relatively spaced apart longitudinally coextensive, double thickness upper and lower hem portions separated by a single thickness intermediate portion, said headband being folded transversely upon itself to define front and rear end folds, a continuous side panel along one side of the headband and relatively telescoping male and female end flaps along the opposite side of the headband, said male end flap being slidable within said female end flap to adjust the head size of said headband; said crown section consisting of a single, rectangular blank of flexible material folded longitudinally upon itself to form a pair of outer side panels joined by a plurality of relatively expansible, intermediate pleats; and adhesive means securing one of the outer side panels of said crown section to both the upper and lower hem portions of the female end flap of said headband and the other outer side panel of said crown section to the continuous side panel of said headband, the male end flap of said headband being adhesively free from said crown section, said one of the outer side panels of said crown section defining with said female end flap an open-ended envelope slidably encasing said male end flap.

2. A cap according to claim 1, wherein the outer side panel of said crown section which is secured to the continuous side panel of said headband is narrower than the other side panel and terminates above the lower hem portion of the continuous side panel of said headband.

3. A cap according to claim 1, wherein said adhesive means is disposed in longitudinally spaced patches along the upper hem portions of the continuous side panel and female end flap of said headband, and substantially continuously along the single thickness intermediate portion of the continuous side panel and the lower hem portion of the female end flap of said headband.

* * * * *